United States Patent [19]

Olson et al.

[11] Patent Number: 4,836,869

[45] Date of Patent: Jun. 6, 1989

[54] HYDROGEN-RESISTANT HIGH-STRENGTH STEELS AND THE METHOD FOR THE MANUFACTURE THEREOF

[75] Inventors: Gregory B. Olson, Winchester; John F. Watton, Belmont; Morris Cohen, Swampscott, all of Mass.

[73] Assignee: Massachusetts Institute of Technology, Cambridge, Mass.

[21] Appl. No.: 125,487

[22] Filed: Nov. 25, 1987

[51] Int. Cl.[4] ..... C22C 38/00

[52] U.S. Cl. ..... 148/331; 420/83; 420/129

[58] Field of Search ..... 148/331, 328; 420/83, 420/88, 129; 417/DIG. 1

[56] References Cited

FOREIGN PATENT DOCUMENTS 56-47510 4/1981 Japan ..... 420/83
58-123857 7/1983 Japan ..... 420/83

OTHER PUBLICATIONS

Olson et al., "Rapidly Solidified Ferrous Alloys", in Proceedings of the TMS-AIME Meeting Held May 1-3, 1985.
Garcia et al., J. of Metals, pp. 22-28 (Sep. 1985).
Lea, Metal Science, pp. 107-112 (Mar. 1980).
Lee et al., Metallurgical Transactions A 15A: 1415-1430 (Jul. 1984).
Kameda et al., Metallurgical Transactions A 14A:9-03-911 (May 1983).
Banerji et al., Metallurgical Transactions A 9A:2-37—247 (Feb. 1978).
Bandyopadhyay et al., Metallurgical Transactions A 14A:881-888 (May 1983).
Seah et al., Metal Science, pp. 307-314 (May 1979).

*Primary Examiner*—Deborah Yee

[57] ABSTRACT

A high-strength steel having improved resistance to hydrogen embrittlement characterized as being essentially free of manganese and having a stable rare earth oxymetalloid dispersion consisting of, e.g., lanthanum oxysulfide and lanthanum phosphate. The steel prepared using rapid solidification processing coupled with late addition of the rare earth.

25 Claims, 1 Drawing Sheet

HYDROGEN-RESISTANT HIGH-STRENGTH STEELS AND THE METHOD FOR THE MANUFACTURE THEREOF

The United States Government has rights in this invention pursuant to contract No. NB83NAHA4024 awarded by the National Bureau of Standards. cl

BACKGROUND OF THE INVENTION

Intergranular stress-corrosion cracking represents a significant problem in ultrahigh strength steels. Such cracking often causes the steel to fail catastrophically. The mechanism of failure is believed to be a hydrogen embrittlement mechanism via cathodic charging of the crack tip that occurs when the steel is in contact with moisture. Segregation of impurities such as sulfur and phosphorus in the grain boundaries of the steel promotes hydrogen embrittlement. Certain steel components, e.g., manganese, silicon, and chromium, are known to promote impurity segregation, and may also promote embrittlement.

SUMMARY OF THE INVENTION

In general, the invention features a high-strength steel (e.g., a steel whose yield strength is greater than about 100 ksi) having improved hydrogen embrittlement resistance that is essentially free of manganese (e.g., the manganese content is less than 0.01 wt. %) and includes a stable rare earth oxymetalloid dispersion. By "stable", it is meant that the rare earth oxymetalloid does not dissolve and return the free metalloid impurity to the steel when the steel is heated at temperatures up to 1100° C. The average particle size of the dispersion is less than one micron (preferably, no greater than 0.1 μm).

The steel is prepared by adding a rate earth (i.e. yttrium or an element having an atomic number between 57 and 71, inclusive) to a melt that includes all the elemental components of the steel except the rare earth, the amount of the rare earth being sufficient to convert substantially all of the metalloids in the melt to the corresponding rare earth oxymetalloids, and then rapidly solidifying the melt under conditions sufficient to form the stable dispersion.

In preferred embodiment, the steel is an ultra-high strength steel (i.e., a steel having a yield strength greater than about 200 ksi) and the rare earth oxymetalloid dispersion includes phosphorous (e.g., in the form of a rare earth phosphate) or sulfur (e.g., in the form of a rare earth oxysulfide), or, more preferably, both. The amounts of phosphorus and lanthanum in the steel are, respectively, less than 0.01 wt. % and 0.1 wt. %. Preferred rare earth elements are lanthanum and cerium, with lanthanum being the most preferred.

In other preferred embodiments, the steel is essentially free of chromium and silicon, as well as manganese (e.g., the steel contains less than 0.01 wt. % of each of these elements). The amount of nickel in the steel is between 1.50 and 3.00 wt. %, the amount of molybdenum between 1.25 and 1.90 wt. %, and the amount of carbon between 0.35 and 0.50 wt. %.

In still other preferred embodiments, the rapid solidification technique used to prepare the steel is atomization, and the melt is superheated prior to the rapid solidification step.

By combining rapid solidification processing with the late addition of a rare earth element (i.e. the rare earth is added after a melt containing the other steel components has been prepared), the invention provides a steel having improved resistance to intergranular stress-corrosion cracking (e.g., exhibiting a constant-load $K_{ISCC}$ of at least 22 MPa(m)$^{\frac{1}{2}}$). The steel also exhibits good mechanical properties, e.g., fracture toughness, hardness, yields strength, and ultimate tensile strength, as well as increased resistance to temper embrittlement. Thus, it is useful in structural applications, e.g., aircraft, where high strength, coupled with corrosion resistance, is required. Because the rare earth is a very effective "gettering" agent for sulfur and phosphorus (i.e. it removes sulfur and phosphorus by reacting with them), large amounts do not have to be added.

Rapid solidification processing (RSP) offers several advantages over conventional processing techniques. RSP permits independent precipitation of the rare earth oxymetalloids as a stable dispersion. Early precipitation of coarse oxygen-depleting rare earth oxide and oxysulfide inclusions, which prevent sufficient oxygen supersaturation required to nucleate rare earth phosphates, is avoided. Moreover, the oxymetalloid phase is produced as a fine dispersion that resists coarsening when exposed to high temperatures (e.g., 3 hours at 1100° C.). Thus, the oxymetalloids do not dissolve and return, e.g., phosphorus and sulfur to the steel matrix. The presence of the fine dispersion also maximizes the mechanical and corrosion-resistance properties of the steel through grain boundary pinning. Compared to conventional grain refining dispersions, the higher surface energy expected for the highly stable oxymetalloid phases inhibits microvoid nucleation, thus promoting high fracture toughness.

Other features and advantages of the invention will be apparent from the following description of the preferred embodiments and from the claims.

DESCRIPTION OF THE PREFERRED EMBODIMENTS

Figure 1:
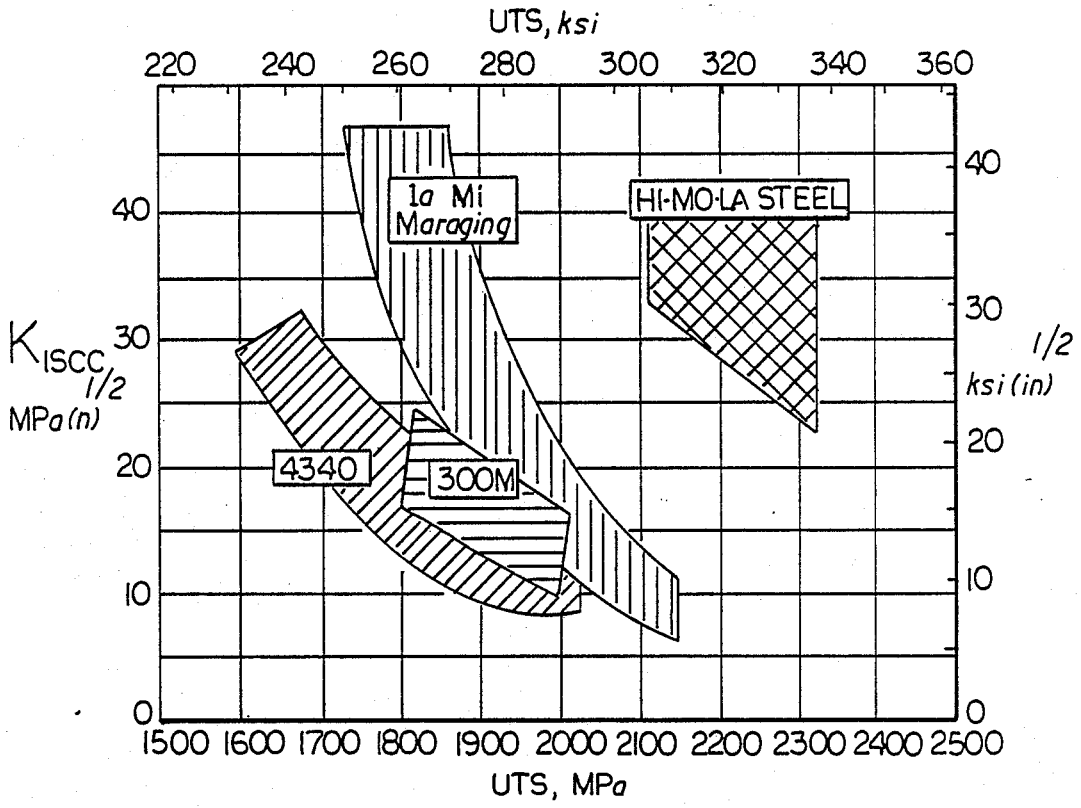

We first briefly describe the Figure.

The FIGURE is a graph comparing the engineering properties of a steel embodying the invention with several conventional steels.

COMPOSITION AND MANUFACTURE

The steel composition is designed to maximize corrosion-resistance without a corresponding loss in mechanical properties such as hardness and fracture toughness. To accomplish this, the composition essentially eliminates manganese, silicon, and chromium because these elements promote segregation of phosphorus and sulfur in the grain boundaries of the steel and reduce boundary cohesion, thus promoting hydrogen embrittlement. However, to offset any loss in hardenability due to the elimination, the amounts of nickel and molybdenum are increased relative to conventional steels. The nickel enhances resistance to transgranular cleavage fracture, while the molybdenum enhances intergranular cohesion. Table 1 compares the composition of a preferred nickel-molybdenum-lanthanum steel embodying the invention with 4340 steel (a standard steel composition of comparable strength level) with respect to carbon, nickel, molybdenum, manganese, silicon and chromium content.

TABLE 1*

| Element | Ni—Mo—La Steel | 4340 Steel |
|---|---|---|
| C | 0.40 | 0.38–0.43 |
| Ni | 2.00 | 1.65–2.00 |

TABLE 1*-continued

| Element | Ni—Mo—La Steel | 4340 Steel |
|---|---|---|
| Mo | 1.50 | 0.20–0.30 |
| Mn | less than 0.01 | 0.60–0.80 |
| Si | less than 0.01 | 0.15–0.30 |
| Cr | less than 0.01 | 0.70–0.90 |

The rare earth gettering agent reacts with sulfur and phosphorus impurities in the steel in the presence of oxygen to form oxysulfide and phosphate reaction products, thereby removing free phosphorus and sulfur. The amount of rare earth required to be added is based upon the stoichiometry of the oxysulfide and phosphate products, the amount of sulfur and phosphorus in the steel, and the anticipated loss of gettering agent during processing due to melt crucible and atmosphere interactions; such interactions occur because the rare earth is highly reactive. In general, the following formula is used:

$$\text{atomic \% rare earth to be added} = [2\ (\text{atomic \% S}) + 1\ (\text{atomic 5 P})][1 + \text{\% loss}/100]$$

where 2 represents the ratio, on an atomic basis, between rare earth and sulfur in an oxysulfide having the formula $R_2O_2S$, and 1 is the rare earth to phosphorus atomic ratio in a phosphate product having the formula $RPO_4$ (R=rare earth). Converting to weight percent for the case where the rare earth is lanthanum, the following formula is used:

$$\text{wt. \% La to be added} = [8.7\ (\text{wt. \% S}) + 4.5\ (\text{wt. \% P})][1 + \text{\% Loss}/100]$$

where 8.7 is the stoichiometric factor based on weight for the lanthanum oxysulfide ($La_2O_2S$) and 4.5 is the factor corresponding to the lanthanum phosphate ($LaPO_4$). The precent loss ranges from 20% to 80% depending upon the atmosphere, crucible material, holding time after rare earth addition and surface area to volume ratio of the melt employed during processing. It is determined in a calibration run.

Generally, the steel is prepared by melting all the steel components except the rare earth together in an alumina-magnesia crucible free of silica in a vacuum induction melting unit, followed by deoxidation. The deoxidized melt is then superheated above the melt temperature (typically to 1630°–1650° C.) and the rare earth added; in the case of lanthanum, it is added as $LaNi_5$. The melt is held at the superheat temperature just long enough to allow the rare earth to dissolve (typically 1–2 minutes). The melt is then solidified by atomization to achieve rapid cooling.

It is important that the cooling rate be as high as possible in order to maintain the oxygen level at the level required to nucleate the rare earth phosphate. Without rapid cooling, undesirable coarse inclusions of rare earth oxides and oxysulfides precipitate instead of the desired independent precipitation of rare earth oxysulfide and phosphate.

Atomization produces the steel in the form of a powder which can then be processed further into the desired shape by, e.g., hot isostatic pressing or hot extrusion followed by hot rolling.

EXAMPLE

A 13.6 kg ingot of a deoxidized steel master alloy having the following composition was prepared using conventional steel practice:

| Element | Weight % |
|---|---|
| C | 0.42 |
| Ni | 2.00 |
| Mo | 1.50 |
| P | 0.002 |
| S | 0.002 |
| Mn | less than 0.01 |
| Cr | less than 0.01 |
| Si | less than 0.01 |
| Fe | balance |

The ingot was then placed in an alumina crucible and remelted in a vacuum induction furnace. Next, the melt was superheated to 1630° C. and 64 g of $LaNi_5$ (0.15 wt. % La addition) added as −100 mesh powder to the melt surface. The melt was held at the superheat temperature for two minutes and then centrifugally atomized in helium gas to produce a fine powder. The cooling rate of the atomized droplets was about $1\times10^{-5}$° C./sec.

The rapidly solidified powder was consolidated by placing it in a thin-walled steel container under a protective argon atmosphere, which was then evacuated and sealed. Next, the container was hot-extruded at 1100° C. to a reduction-in-area of 20:1 to produce the alloy in the form of a 1.75 cm diameter bar.

The alloy bar was austenitized by heating for 1 hour at 1100° C. under vacuum, followed by an oil quench to room temperature. The bar was then tempered for 1 hour at 200° C. in air and then air-cooled to room temperature.

The steels prepared as described above exhibited improved resistance to intergranular stress-corrosion cracking, having constant-load $K_{ISCC}$ values of at least 22 MPa(m)$^{1/2}$. Yield and tensile strengths of 1863 MPa and 2450 MPa, respectively, were achieved, as well as sharp crack fracture toughness ($K_{IC}$) of 66 MPa(m)$^{1/2}$ at 55 HRC with 100% ductile fracture.

The Figure shows a comparison of the $K_{ISCC}$ value v. ultimate tensile strength (UTS) between the Ni-Mo-La steel embodying the invention and three conventional high strength steels (4340, 300 M, and 18 Ni Maraging). As the FIGURE indicates, the Ni-Mo-La steel exhibits markedly improved properties.

Other embodiments are within the following claims.

For example, other rapid solidification techniques, e.g., melt spinning and inert gas atomization, can also be used.

We claim:

1. A high-strength steel having improved resistance to hydrogen embrittlement, said steel characterized as consisting of less than 0.01 wt % manganese and having a stable rare earth oxymetalloid dispersion comprising phosphorus wherein the average particle size of the dispersion is less than one micron.

2. The steel of claim 1 wherein said steel is essentially free of chromium and silicon.

3. The steel of claim 1 wherein said phosphorus is in the form of a phosphate in said dispersion.

4. The steel of claim 1 wherein said rare earth oxymetalloid dispersion further comprises sulfur.

5. The steel of claim 4 wherein said sulfur is in the form of an oxysulfide in said dispersion.

6. The steel of claim 4 wherein said phosphorus is in the form of a phosphate and said sulfur is in the form of an oxysulfide in said dispersion.

7. The steel of claim 1 wherein the amount of sulfur in said steel is less than 0.01 wt. %.

8. The steel of claim 1 wherein the amount of phosphorus in said steel is less than 0.01 wt. %.

9. The steel of claim 1 wherein said rare earth comprises lanthanum.

10. The steel of claim 1 wherein said rare earth comprises cerium.

11. The steel of claim 1 wherein said rare earth oxymetalloid dispersion comprises lanthanum phosphate.

12. The steel of claim 1 wherein said rare earth oxymetalloid dispersion comprises lanthanum oxysulfide.

13. The steel of claim 1 wherein the amount of nickel in said steel is between 1.50 and 3.00 wt. %.

14. The steel of claim 1 wherein the amount of molybdenum in said steel is between 1.25 and 1.90 wt. %.

15. The steel of claim 1 wherein the amount of carbon is said steel is between 0.35 and 0.50 wt. %.

16. The steel of claim 1 wherein said steel exhibits a constant-load $K_{ISCC}$ of at least 22 MPa(m)$^{\frac{1}{2}}$.

17. The steel of claim 1 wherein said steel is an ultra-high strength steel.

18. The steel of claim 1 wherein the average particle size of said dispersion does not exceed 0.1 μm.

19. A process for preparing a high-strength steel having improved resistance to hydrogen embrittlement comprising the steps of providing a melt comprising the elemental components of said steel including less than 0.01 wt % manganese but excluding rare earth elements;

adding a rare earth to said melt in an amount sufficient to convert substantially all of the metalloids in said melt to rare earth oxymetalloids including phosphorus; and rapidly solidifying said melt to form said steel under conditions sufficient to form a stable rare earth oxymetalloid dispersion comprising phosphorus in said steel wherein the average particle size of the dispersion is less than one micron.

20. The process of claim 19 wherein said rare earth comprises lanthanum.

21. The process of claim 19 wherein said rare earth comprises cerium.

22. The process of claim 19 wherein said rapid solidification comprises atomization.

23. The process of claim 19 wherein said melt is superheated prior to said rapid solidification.

24. The process of claim 19 wherein said steel is an ultra-high strength steel.

25. The steel prepared according to the method of claim 19.

* * * * *

UNITED STATES PATENT AND TRADEMARK OFFICE

CERTIFICATE OF CORRECTION

PATENT NO. : 4,836,869

DATED : June 6, 1989

INVENTOR(S) : Gregory B. Olson, John F. Watton, and Morris Cohen

It is certified that error appears in the above-identified patent and that said Letters Patent is are hereby corrected as shown below:

Column 1, line 8, after ".", delete "cl";
line 45, change "embodiment" to --embodiments--.
Column 3, line 7, after Table 1, insert
--* All amounts given as weight percent.--;
line 22, change "5" to --%--.
Column 4, line 52, after "consisting", insert
--essentially--.
Column 5, line 16, change "is" (first occurrence) to --in--.
Column 6, line 5, after "metalloids", insert --, including phosphorus,--;
lines 6-7, delete "including phosphorus";
line 23, change "The" to --A--.

Signed and Sealed this

Twenty-third Day of April, 1991

*Attest:*

HARRY F. MANBECK, JR.

*Attesting Officer*

*Commissioner of Patents and Trademarks*